United States Patent [19]

Couture et al.

[11] 4,365,557

[45] Dec. 28, 1982

[54] AIR DEPLOYABLE INCENDIARY DEVICE

[75] Inventors: Joseph E. G. Couture, Cap Rouge; Philip A. Twardawa, Shannon, both of Canada

[73] Assignee: Her Majesty the Queen in right of Canada, as represented by the Minister of National Defence, Ottawa, Canada

[21] Appl. No.: 189,854

[22] Filed: Sep. 22, 1980

[30] Foreign Application Priority Data

Jun. 3, 1980 [CA] Canada ..... 353323

[51] Int. Cl.[3] ..... F42B 25/14; F42B 4/26

[52] U.S. Cl. ..... 102/341; 102/364

[58] Field of Search ..... 102/341, 364

[56] References Cited

U.S. PATENT DOCUMENTS

| | | | |
|---|---|---|---|
| 2,920,560 | 1/1960 | Clauser et al. | 102/341 |
| 3,296,967 | 1/1967 | Bounds et al. | 102/364 |
| 3,766,858 | 10/1973 | Handler et al. | 102/341 |
| 3,951,068 | 4/1976 | Schroeder | 102/364 |
| 4,069,762 | 1/1978 | Maury | 102/341 |
| 4,155,307 | 5/1979 | Kluchert et al. | 102/341 |

*Primary Examiner*—Edward A. Miller

*Attorney, Agent, or Firm*—Cushman, Darby & Cushman

[57] ABSTRACT

The invention disclosed is a floating incendiary device adapted to be dropped from an aircraft onto a combustible material on a body of water. The device includes means for directing the resulting heat by convection and radiation to concentrate on a particular area of the combustible material for a time sufficient to raise the temperature of the combustible material to its fire point to produce ignition and self-sustaining combustion of the combustible material. A novel incendiary composition for use with the device is also disclosed.

25 Claims, 5 Drawing Figures

AIR DEPLOYABLE INCENDIARY DEVICE

Figure 1:
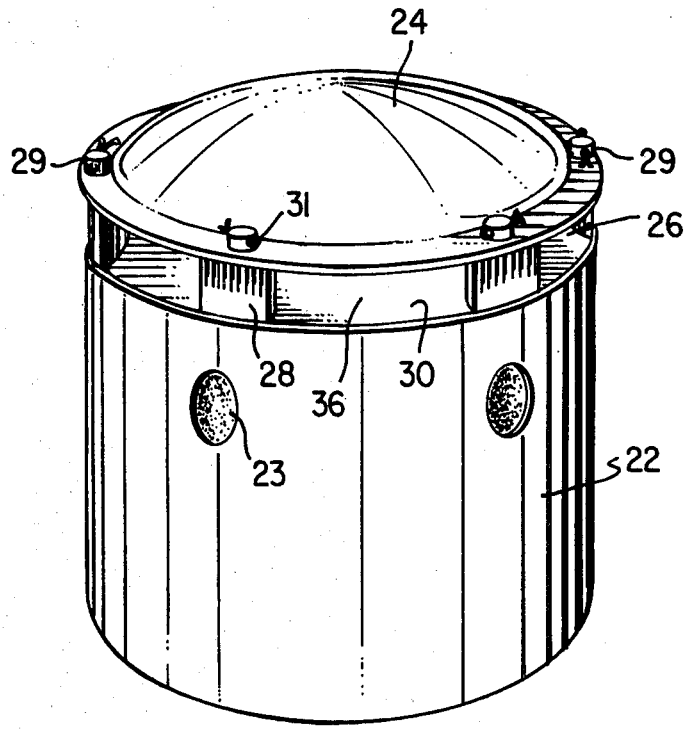

This invention relates to a floating incendiary device for igniting combustible material on the surface of a body of water.

Hydrocarbon slicks floating on water, resulting from such occurrences as subsea oil well blowouts and shipping accidents, are catastrophic for the affected marine environment. With increasing numbers of subsea exploratory and production oil wells, and an increasing volume of shipping traffic relying on progressively larger tankers, disastrous contamination of the environment is not only possible but probable. The situation is further aggravated by exploratory wells and shipping steadily moving northward into perilous, ice-infested waters.

To date no efficient method for the cleanup of these slicks exists. While containmant and/or recovery techniques have a limited application under certain ideal conditions, a large-scale spill on the open seas generally precludes their use. In the north the remoteness and hazardous ice conditions further discourage operators from attempting clean-up.

What is undoubtedly the most practical solution, if not the only solution, to the disposal of many of these spills is their in situ combustion. While often looked on as a "last resort option" in that the smoke and residual sludge resulting from a burn themselves contribute to the pollution of the environment, the overall polluting effect can be reached by as much as 90%.

In the North, the remoteness of the location and the dangers brought about by the presence of ice further support the employment of in situ combustion. In the typical oilspill scenario it is conceivable that a blowout could occur near the end of the drilling season, and the forthcoming freeze-up would force the operator to abandon the site before capping the well. In this case, the blowout would run wild until capped the next drilling season. It is popularly hypothesized that in this interim the crude oil would accumulate under the ice cover, spreading out as dictated by surface ocean currents, until the spring thaw at which time it would percolate up through brine channels in an essentially unweathered state. This crude would then form slicks on literally thousands of melt pools extending over a narrow corridor but strung out over possibly 1000 km. Owing to the vastness of the affected area, the precarious nature of the ice cover, and the remoteness of the spill site, it would be technically impossible to move men and equipment onto the ice surface to effect a cleanup. Quite understandably the only viable solution to its disposal is in situ combustion, where each slick would have to be separately ignited by incendiary devices dropped from low flying aircraft.

The major problem associated with in situ combustion is, however, that to date there just is no reliable and practical method of igniting these slicks, be they in the North or in more southern shipping lanes. Although the slicks consist of volatile hydrocarbons, and they burn vigorously when lit, their actual ignition is deceptively difficult. The problem is created by the slick thinning out to the point where the heat energy input to initiate combustion is lost to the underlying water (which serves as an infinite heat sink) rather than conserved within the slick to raise its local temperature to the fire point. The problem is further aggravated by the chemical degradation (weathering) of the slick which tends to remove or isolate the more volatile components, raising its fire point and hence making its ignition substantially more difficult. Finally the problem can be taken one step further if one is to adopt the Arctic melt pool scenario as described previously. In this situation there may conceivably be thousands of small slicks in melt pools that must be individually lit over a short time period, in a very treacherous and remote environment.

At present, there is a very limited selection of incendiary devices on the market that have been designed specifically for the ignition of hydrocarbon slicks. One such device is known by the trade name of Kontax marketed by Scheidemandel A.S., Hamburg, West Germany. It consists essentially of a cylinder filled with calcium carbide and incorporating a sodium metal bar in the center. Upon contact with water, the sodium reacts to produce burning hydrogen gas and the calcium carbide reacts to produce acetylene gas, which is ignited by the hydrogen and in turn ignites the crude oil. Some success has been achieved using this device, but in practice the production of calcium hydroxide foam isolates the device from the crude oil and any possibility for ignition is largely impaired.

Other incendiary devices that have been used include napalm, a gasoline gel with a white phosphorus igniter set off by a burster fuse. The burster fuse, when fired, spreads the gel and burning phosphorus over a large area. Of similar operation are firebomb igniter devices consisting of a combustible metal and a fluoroalkylene polymer e.g. magnesium metal and polytetrafluoroethylene (teflon ®) as described in U.S. Pat. No. 3,669,020 which issued June 13, 1972 to H. Waite et al. In this particular magnesium-teflon ® igniter, a burster fuse disseminates small burning particles that continue to burn for several seconds and provide ignition points for areas of fuel concentration. The failure of these devices is that the hot spots produced are too small and of too short a duration to enable self-propagation of a flame and sustained combustion in all but the most volatile and concentrated slicks.

As mentioned earlier, the main problem with the available commercial igniters is that none of them have been tailor-made exclusively for the ignition of low-volatile hydrocarbon slicks and in Arctic conditions. Both the magnesium-teflon ® igniter of the above mentioned U.S. Pat. No. 3,669,020 and napalm suffer from the drawback that they produce heat for only several seconds, whereas the preheat time for a thin slick would have to be in the order of minutes with an igniter having this radiant heat flux. Similar is the case with thermite (a mixture of ferric oxide and powdered aluminum, usually enclosed in a metal cylinder and used as an incendiary bomb) which, although burning very hot, is consumed very rapidly with the result that there is little overall heat transfer to the slick.

Priming a slick with large quantities of a more volatile fuel and adding rags, straw, and commercial wicking agents in copious amounts may eventually help to get the slick burning, but clearly this is not the most practical approach either. If one considers again the Arctic melt pool scenario, the sheer size of the possible contaminated area and the huge numbers of oiled melt pools demand that the incendiary device be much more versatile i.e. it must be small, lightweight, and quickly deployable in order to permit its being dropped from low flying aircraft.

Finally, none of the incendiary devices examined thus far are efficient in their operation. While most generate sufficient heat to raise enough of the slick to its fire point so that a self-sustaining combustion could be achieved, in all cases the major proportion of the generated heat is lost to the atmosphere with the result that in most cases no ignition takes place. The size and mass constraints imposed by the Arctic scenario demand that the incendiary device be efficient in its operation: a large proportion of the heat it produces must be used to heat the slick, with relatively little lost to the air.

It is therefore an object of the present invention to provide an air-deployable incendiary device to fill the role as created by the Arctic melt pool scenario i.e. the ignition and subsequent combustion of thousands of oil slicks covering melt pools, dispersed over an immense surface area.

Another object of the invention is to provide an incendiary device which is small and light such that the effective range of the aircraft will not be substantially diminished.

Yet another object of the invention is to provide a device which is easily and rapidly deployed from low flying aircraft.

According to one aspect of the invention, a floating incendiary device for igniting a combustible material on the surface of a body of water, comprising, a casing; flare means disposed in said casing; firing means for igniting said flare means; flotation means associated with said casing to maintain the device in a substantially upright position on the water, wherein the flame of said flare is maintained above the surface of the water; and deflector means for directing the flame of said flare onto said combustible material.

According to another aspect of the invention, an incendiary composition is provided for use in an incendiary device according to the invention, the composition consisting of

| | |
|---|---|
| (a) ammonium perchlorate | 40–70%/w |
| (b) a fuel selected from aluminum and magnesium | 10–30%/w |
| (c) an hydroxy-terminated polybutadiene binder | 14–22%/w |

Figure 3:
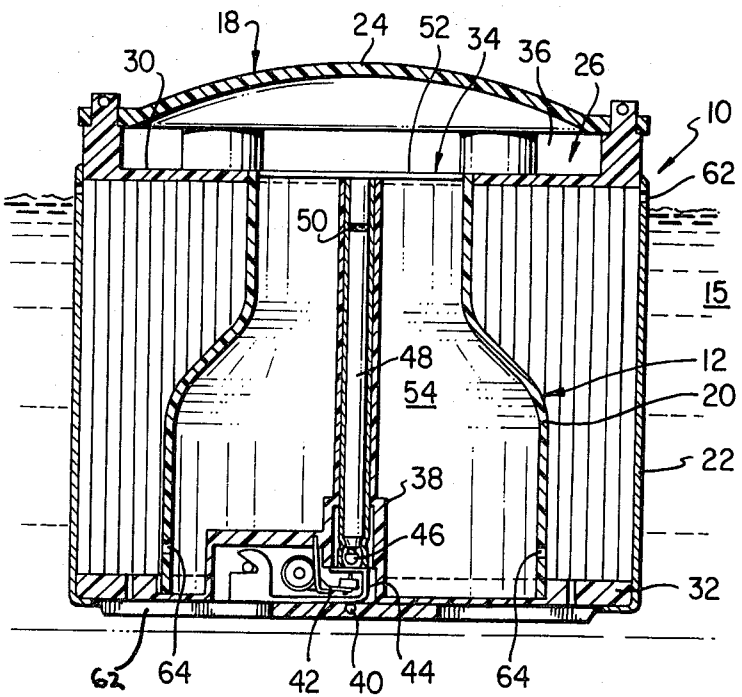
Figure 2:
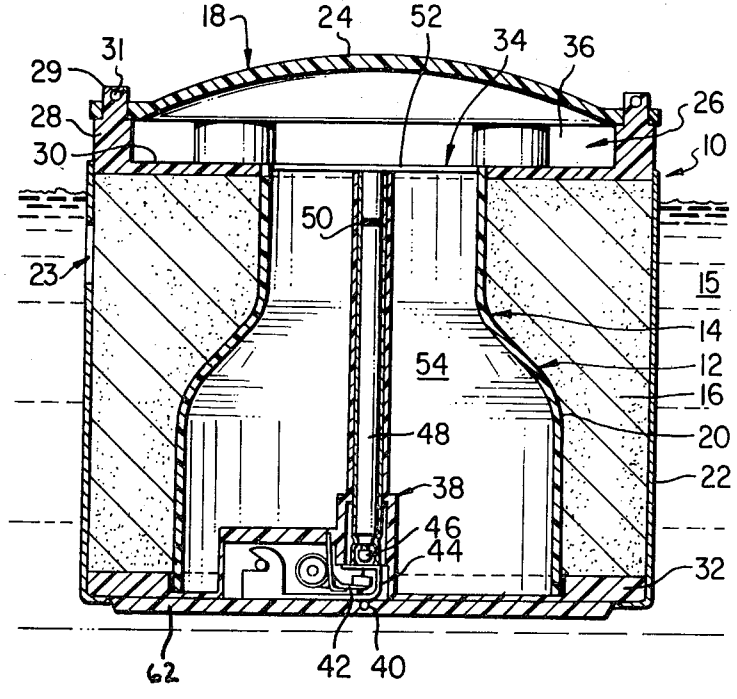
Figure 4:
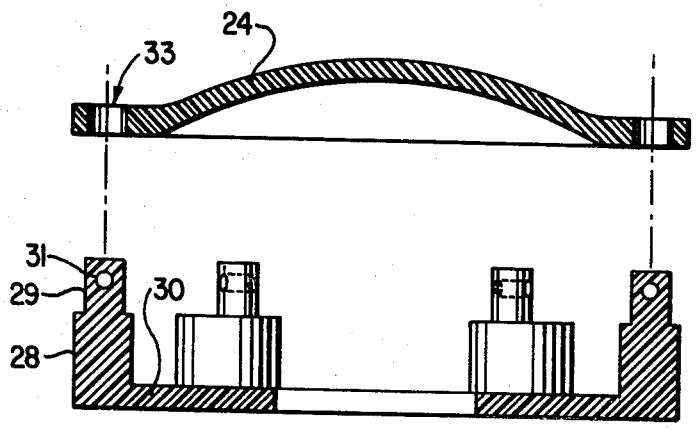
Figure 5:
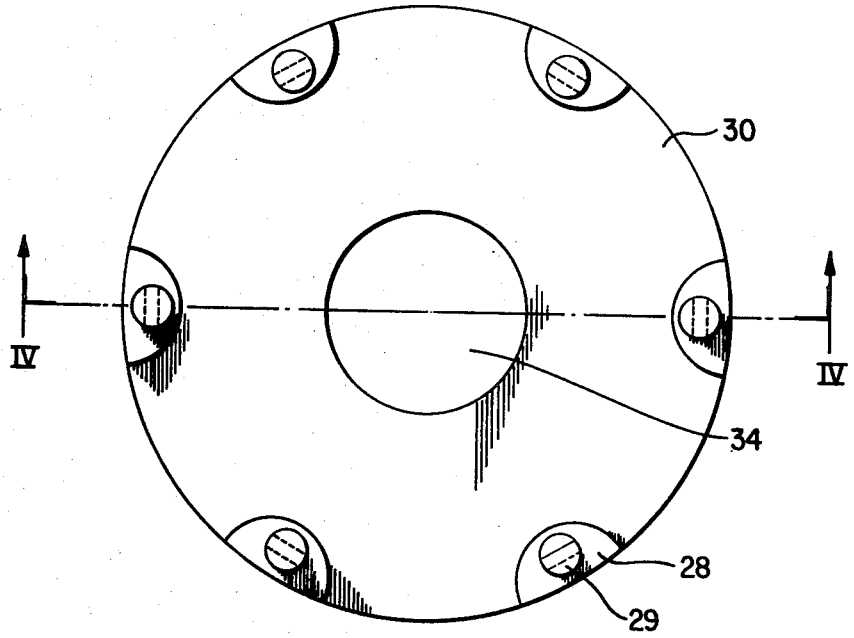

In the drawings which serve to illustrate embodiments of the invention,

FIG. 1 is a perspective view of an incendiary device according to the invention, FIG. 2 is a side elevation in section of one embodiment of the incendiary device according to the invention, FIG. 3 is a side elevation in section of another embodiment of the incendiary device according to the invention, FIG. 4 is a side elevation in section of part of the incendiary device according to the invention illustrating the connection of the dome member to the device, and FIG. 5 is a plan view of the top disc of the device.

With particular reference to the FIG. 2 embodiment, the incendiary device 10 is seen to comprise a casing 22, a flare means 12 which comprises a retainer 20 and a suitable incendiary composition 54. Flotation means 16 is provided to maintain the flame of the flare 12 above a body of water 15. Deflector means 18 is provided for directing the flame onto a combustible material such as low-volatile hydrocarbons, floating on the surface of the body of water 15.

More specifically, retainer 20 is in the form of a tapered cylindrical member of a fire-proof heat insulating material such as a glass-fiber filled high temperature resistant phenolic material e.g. a material sold under the trade designation FM-16671 by Fiberite Corp. of Wynona, Minn. Flotation means 16 is preferably in the form of closed cell polyurethane foam although other suitable closed cell foam material could be employed. The foam 16 is typically injection molded into the body of the device i.e. the space defined by the thin light-weight metal (e.g. aluminum) cylindrical open-ended casing 22 and retainer 20. The foam material thus serves the dual purpose of flotation means and shock absorber to absorb the shock at impact following air-deployment. Radial vents 23 are provided in the cylindrical casing 22 to permit access to water to the interior as will become apparent hereinafter.

Deflector means 18 is preferably hemispherical, specifically a segment of a sphere structure 24 which is spaced from the casing 22 in an umbrella-like arrangement and presents a concave surface to the flame of the flare to deflect the flame through a peripheral opening 26 between the dome 24 and the casing 22. The diameter of the dome is substantially the same as that of cylindrical jacket 22.

A top annular disc member 30 of the same fire proof material as the retainer 20 and the dome 24 is provided to close the open top of the metal casing 22 and thus serves to insulate the foam material 16 from heat radiated downwardly from the dome 24. The metal casing 22 is crimped over the disc 30 to hold it in place. The joint between disc 30 and casing 22 is coated with an epoxy to ensure water tightness. A central circular opening 34 is provided in top disc 30 to provide access to the flame of flare 54 to dome 24.

The top disc 30 includes a plurality, conveniently six, of integral upstanding arms 28 which define the standoff of the dome 24 from the casing 22 and hence the size of the opening 26. Arms 28 include an external reduced diameter portion 29 and an opening 31. As best seen in FIG. 4 an opening 33 is provided in dome 24 so that the dome may be seated in position. A cotter pin or the like may be inserted through the exposed opening 31 to fasten the dome securely in position. The heat of the flame is thus concentrated by convection and radiation onto a circular area of the combustible liquid about the device of a diameter of about 0.6 to 1.0 meters for a time sufficient (about 2–2½ minutes) to raise the temperature of this area of the combustible liquid to produce ignition and self-sustaining combustion of the liquid, without propelling the device. The area upon which the heat is concentrated is a compromise between the heat output of the device and the heating of a larger area. The radiated heat should be sufficient to raise the temperature at the boundary of the heated area to at least 100° C. in ambient air and a water temperature of 0° C., providing the oil spill is at least 0.5 cm thick.

The dome 24 is typically made of the same fire-proof material as the cylindrical member 20 and is capable of withstanding temperatures of the order of 2300° C. which occur during the course of the burn of the flare to direct the flame and hot gases and concentrate the heat onto the combustible material to heat the material by both convection and radiation. The glass fibers used in the material are interwoven permitting it to withstand both the physical shock of impact following air deployment and the thermal shock due to rapid heating from ambient temperatures to about 2300° C.

The other end of the metal casing 22 is closed by a water-tight closure member 32 typically of the same phenolic material as the dome 24. Closure is effected by crimping the metal casing 22 over the closure 32. The joint between members 22 and 32 is coated with a water-proof sealant e.g. an epoxy to ensure that it is water-tight.

The space 36 may be initially filled with a foam material in order to absorb the impact shock in the event that the device lands upside down and helps to quickly right the device prior to burn. This foam will be rapidly burned off in the first few seconds following ignition of the flare. Further, the foam is cast to extend beyond the dome 24 and form a square shape. This will prevent the device from rolling around in the aircraft should it slip from the operator's hands during deployment.

A firing means 38 is encased within the metal casing 22 and serves to ignite the flare. The ignition of the flare is now described in relation to the operation of the firing means 38. At the moment of deployment from the aircraft, a safety pin 40 is pulled and a sprung striker 42 is armed and released by pulling on a firing clip 44. The striker 42 initiates a small 9-mm primer cap 46 which in turn activates burning of the delay fuse column 48. This latter burns at a rate of about 0.5 cm/sec, and thus after approximately a 20-second delay the burn reaches the end of the delay column and ignites the transfer/igniter powder 50, the ignition composition 52 and finally the incendiary composition (flare) 54. This pyrotechnic delay igniter is of similar design as those commonly employed in conventional hand grenades excepting certain hardware changes and lengthening of the delay column. The delay is mainly for safety purposes to permit sufficient release time, and to permit the device to self-right and allow water surface conditions to recover from rotor downwash effects if the aircraft employed is a helicopter.

The incendiary composition 54 burns at the upper exposed surface; as the burning continues this surface recedes at a rate of approximately 5 cm/minute to provide a 2–2.5 minute burn. The incendiary composition which is pour cast to substantially fill retainer 22, burns in a cigarette-fashion provided that a good bond is present between the incendiary composition and the retainer 20. The intense flame and hot gases produced by the combustion are directed vertically upwards through opening 34 to impinge upon the heat-reflecting dome 24 which redirects them radially outwards through the peripheral opening 26 and concentrates the heat onto the combustible material. The size of this peripheral opening (i.e. the standoff of the dome) is arranged as mentioned previously to provide for the maximum heat flux onto the surface of the combustible material.

Since the delay column is gasless, there is no resultant pressure buildup during the course of its burn and hence this delay column is suitable for such a confined location. Accidental firing of the igniter is eliminated by the presence of the safety pin. Furthermore, because the striker is unarmed until movement of deployment (the spring has no torque applied) and because it is physically isolated from the primer cap by the firing clip, the possibility of activation of the delay igniter by vibration is virtually eliminated. The safety features and long delay inherent in this delay igniter make it very suitable for its deployment from aircraft.

As the incendiary composition 54 is consumed, the device rises in the water and the series of radial side vents 23 in the thin metal casing 22 adjacent the initial water-line will become exposed above the surface of the combustible material. The intense heat being radiated from the dome 24 will melt the foam 16 adjacent the disc top 30 to below the water line and the device will settle back down to maintain the standoff of opening 26 from the combustible material to maintain the designed efficiency of heat transfer to the combustible material. This gentle bobbing will continue throughout the burn and will result in a larger area of the slick surface being uniformly heated.

The FIG. 3 embodiment is basically the same as that of FIG. 2, except that alternate floatation means 16 is provided. Instead of foam, an insert made of a suitable honeycomb material e.g. polypropylene, that has been extrusion moulded to the shape of the space. This insert has the advantage of simplifying and accelerating the assembly process.

The polypropylene insert serves the same function equally well as the foam in absorbing the impact shock, and providing the crimping joints are watertight the proper buoyancy is maintained (i.e. the insert is very light). The main advantage however lies in the scuttling feature that this insert allows for. Since the real volume of the polypropylene material occupies less than 10% of the insert, the remaining air space can be allowed to progressively fill with water as the device floats during combustion of the incendiary composition. This is accomplished by providing small port holes 60 in the bottom of casing 22. Air which formerly occupied the open spaces is allowed to vent through holes 62 provided in casing 22 adjacent the top of the casing. Holes 60 and 62 are sized (1/32–1/16") so that the water intake exactly compensates for the mass loss of incendiary composition as the device burns. In this way the incendiary device maintains its low aspect in the water at all stages during the burn, hence the high efficiency of heat transfer to the slick surface afforded by the dome is maintained.

A further advantage of this alternate method of floatation is the scuttling ability. As the incendiary composition nears burnout, it melts a thin plastic covering to open scuttling holes 64 in member 20, allowing for the passage of water into the interior of the cone i.e. space formerly occupied by incendiary composition. What is left of the incendiary device is then no longer able to displace enough water to remain afloat and sinks, minimizing any harmful effect of its presence in the environment.

Another feature of the design of the incendiary device is that due to its low center of gravity the device quickly self-rights, assumes and maintains a stable upright orientation in the water, being bottom heavy due to the tapered shape of the incendiary filled retainer 22, and having a low aspect in the water at all times during the burn. Moreover, the use of foam or honeycomb structure absorbs the shock at impact, eliminating the need for a heavier, more structurally rigid construction to fulfill its air-droppable requirement. In this way the actual incendiary composition accounts for the major percentage of the total mass of the device, an important consideration in view of logistical limitations imposed by an Arctic application. Consisting uniquely of proven-reliable ingredients and components, the incendiary device can be expected to have a long storage life, in the order of 10 years at temperature ranging from −50° C. to +50° C. A typical device according to the invention has a unit weight of about 2 Kg. and 225 units and the associated airworthy storage space is of the order of 0.75 m wide, 1 m long and 1.3 m high. The device is light enough to float freely in as little as 10 cm of fresh water.

The overall size of the outer jacket 22 is chosen to give the incendiary device a low aspect in the water to promote its stability and to position the heat-reflecting dome 24.

The incendiary composition is itself unique in that is has been formulated specifically for this application. Bearing some resemblance to a solid rocket motor propellant, the proportions of ingredients have been altered and others added to yield the very desirable properties of a steady, controlled slow combustion (4–7 cm/minute) while at the same time providing a very high flame temperature (1450°–2300° C.) and a large radiant heat flux. The formulation of the incendiary composition is typically in the neighbourhood of 40–70%/w ammonium perchlorate oxidizer, 10–30%/w solid metal fuel, preferably magnesium or aluminium, and 14–22% binder as described in more detail below. In addition small amounts of other ingredients, including thickeners such as dextrin and Cab-O-Sil (a trademark for colloidal silica particles sintered together in chain-like formations), are generally present in the incendiary composition. These provide a very finely-ground silica which is required to increase the viscosity of the formulation during the casting process and prevent any stratification or sedimentation of ingredients at the curing stage. In this manner the compositions are easily processed by standard propellant-industry equipment (or even less specialized equipment) and behave well in casting, and hence are well suited for this application.

A preferred binder in the incendiary composition of the present invention is based on an hydroxyl-terminated polybutadiene polymer, such as the Poly BD ®R-45HT manufactured by Arco Chemical Company, cured with a commercial diisocyanate such as DDI ®-1410 marketed by General Mills or any other suitable isocyanate. The binder is preferably plasticized with from 20 to 30% by weight of an ester such as isodecyl pelargonate (IDP). Other additives might be present in the binder in order to improve the mix viscosity and the strength and elongation of the binder.

In further explanation of the incendiary composition, there are presented below specific examples and burn characteristics of said compositions. In these examples, as throughout the description, all percentages are by weight unless otherwise specified.

A formulation comprising 55% ammonium perchlorate, 30% aluminium and 15% binder resulted in a burn rate of 5.6 cm/min with a flame temperature of 2250° C. A similar composition consisting of 60% ammonium perchlorate, 20% aluminium and 20% binder clearly shows the effect of the increased proportion of binder with a slower burning rate of 4.5 cm/min and a much cooler flame temperature, 1450° C. Both compositions yield a columnar stream of sparks during combustion, providing a very intense source of heat.

Using magnesium as the fuel, burning rates and flame temperatures tend both to be higher, with fewer sparks emmanating in a more dispersed fashion. A mixture of 57% ammonium perchlorate, 25% magnesium and 18% binder provides for a burn rate of 6.5 cm/min and a flame temperature of 2350° C. A slight increase in oxidizer content to 62% ammonium perchlorate and corresponding decrease in fuel content with 20% magnesium, with the 18% binder content remaining the same, slows down the burn rate slightly to 6.0 cm/min at the same flame temperature of 2350° C.

Tailoring of this device to fulfill the requirement imposed by the Arctic melt pool scenario does not in any way preclude its use on other crude oil spillages. Since the incendiary device is capable of igniting slicks that are at the lower limit of combustibility, regardless of their size, the device will be equally effective in more southern climates on open-sea slicks resulting from accidental spillages, providing that they are combustible.

We claim:

1. A floating incendiary device for igniting a combustible material on the surface of a body of water, comprising:

a casing;

flare means disposed in said casing;

firing means for igniting said flare means;

flotation means associated with said casing to maintain the device in a substantially upright position on the water, wherein the flame of said flare is maintained above the surface of the water; and deflector means for directing the flame of said flare onto said combustible material.

2. A floating incendiary device according to claim 1, wherein said combustible material is a liquid.

3. A floating incendiary device according to claim 1 or 2, wherein said combustible material is a low-volatile hydrocarbon.

4. A floating incendiary device according to claim 1, wherein said flotation means is of a closed cell foam material.

5. A floating incendiary device according to claim 4, wherein said foam material is polyurethane foam.

6. A floating incendiary device adapted to be dropped from an aircraft onto a body of water, self-right and thereafter float in a substantially upright position, for igniting a combustible material on the surface of said body of water, comprising:

a casing, flare means disposed in said casing;

flotation means associated with said casing to maintain the device in a substantially upright position on the water, wherein the flame of said flare is maintained above said surface;

deflector means for directing said flame onto said combustible material; and firing means adapted to be ignited on board said aircraft, including delay fuse means, for igniting said flare after landing and righting of said device on the body of water; wherein the center of gravity of said device is sufficiently low so that the device is self-righting.

7. A floating industry device according to claim 6, wherein said combustible material is a liquid.

8. A floating incendiary device according to claim 6 or 7, wherein said combustible material is a low-volatile hydrocarbon.

9. A floating incendiary device according to claim 6, wherein said flotation means if of a closed cell foam material.

10. A floating incendiary device according to claim 7, wherein said foam material is polyurethane foam.

11. A floating incendiary device adapted to be dropped from an aircraft onto a body of water, self-right and thereafter float in a substantially upright position, for igniting a spill of combustible liquid on the surface of said body of water, comprising:

a casing;

flare means disposed in said casing;

flotation means associated with said casing to maintain the device in a substantially upright position on the water, wherein the flame of said flare is maintained above said spill;

deflector means for directing said flame onto said combustible liquid; and firing means adapted to be ignited on board said aircraft, including delay fuse means, for igniting said flare after landing and righting of the device on said body of water, wherein the center of gravity of said device is sufficiently low so that the device is self-righting, and wherein the heat of said flame is concentrated on a particular area of the combustible liquid for a time sufficient to raise the temperature of the liquid to the fire point of said liquid to produce ignition and self-sustaining combustion of said liquid.

12. A floating incendiary device according to claim 11, wherein said combustible liquid is a low volatile hydrocarbon.

13. A floating incendiary device according to claim 11 or 12, wherein said flotation means is of a closed cell polyurethane foam material.

14. A floating incendiary device adapted to be dropped from an aircraft onto a body of water, self-right and thereafter float in an upright position, for igniting a spill of combustible liquid on the surface of said body of water, comprising an open-topped light-weight cylindrical casing;

flare means disposed in said casing;

flotation means disposed in said casing to maintain the device in a substantially upright position on the water, wherein the flame of said flare is maintained above said surface;

deflector means of a suitable flame-proof material in the form of a hemispherical dome structure of substantially the same diameter as said cylindrical casing spaced from said casing in an umbrella-like arrangement to provide a peripheral opening between said casing and said dome structure about the circumference of said dome structure;

closure means for said open-topped casing, of a suitable fire-proof heat-insulating material having a central opening to provide access for said flare to said deflector means;

arm means associated with said closure means for rigidly mechanically attaching said deflector means to said casing; and firing means adapted to be ignited on board said aircraft, including delay fuse means for igniting said flare after landing and righting of the device on said body of water; wherein the center of gravity of said device is sufficiently low so that the device is self-righting in the water, and wherein the heat of said flame is directed through said peripheral opening by said dome structure by convection and radiation to concentrate on a circular area of the combustible liquid of a diameter of about 0.6 to 1.0 meters, about the device, for a time sufficient to raise the temperature of the liquid to the fire point to produce ignition and self-sustaining combustion of said liquid.

15. A floating incendiary device according to claim 14, wherein said flare means comprises:

a suitable incendiary composition housed in a cylindrical retainer of a suitable flame-proof material, said retainer including a section of larger diameter tapering to a section of smaller diameter, said section of smaller diameter being in communication with and of the same diameter as the central opening in said closure means.

16. A floating incendiary device according to claim 15, wherein said incendiary composition is pour cast to fill said retainer, such that once ignited it burns in a cigarette-like manner.

17. A floating incendiary device according to claim 13, wherein said flotation means is a suitable closed-cell foam material.

18. A floating incendiary device according to claim 17, wherein said foam is a polyurethane foam.

19. A floating incendiary device according to claim 17 or 18, wherein said foam material is injection molded to substantially fill the space defined by said casing and said retainer.

20. A floating incendiary device according to claim 15, wherein said flotation means is in the form of an insert of a suitable honeycomb material extrusion molded to the shape of the space defined by said casing and said retainer.

21. A floating incendiary device according to claim 17 or 18, including a series of radial openings in said casing adjacent the initial water line, arranged such that as the incendiary composition is consumed, the device rises in the water and the series of radial openings become exposed above the surface of the combustible material, the heat radiation from the peripheral opening melts the foam adjacent said closure means to below the water line to maintain the stand-off of the peripheral opening from the combustible material.

22. An incendiary device according to claim 15, 17 or 20, wherein the material of said dome structure, said closure means and said retainer is of a suitable glass-fibre filled phenolic resin.

23. A floating incendiary device according to claim 20, wherein said honeycomb material is polypropylene.

24. A floating incendiary device according to claim 20 or 23, wherein port holes of appropriate size are provided adjacent the bottom of the casing and air vent holes are provided in the casing adjacent the top of the casing to permit water intake into the casing through the port holes to compensate for the mass loss as the incendiary composition is consumed and to permit air which formerly occupied open spaces in said honeycomb material to be vented out of said casings to maintain substantially the same relative positioning of the device in the water.

25. An incendiary device according to claim 15, 17 or 20, wherein said flare has a burn time of about 2–2½ minutes at a temperature in the range of 1450°–2300° C.

* * * * *